US007673373B2

(12) United States Patent
Chang et al.

(10) Patent No.: US 7,673,373 B2
(45) Date of Patent: Mar. 9, 2010

(54) FRAMELESS GLASS DOOR CLAMP

(75) Inventors: Wei-Hung Chang, Taichung (TW); Chih-Lun Hsieh, Taichung (TW)

(73) Assignee: Door & Window Hardward Co., Taichung (TW)

( * ) Notice: Subject to any disclaimer, the term of this patent is extended or adjusted under 35 U.S.C. 154(b) by 462 days.

(21) Appl. No.: 11/636,489

(22) Filed: Dec. 11, 2006

(65) Prior Publication Data

US 2008/0093520 A1 Apr. 24, 2008

(30) Foreign Application Priority Data

Oct. 19, 2006 (TW) ..... 95218478 U

(51) Int. Cl.
*E05D 11/00* (2006.01)

(52) U.S. Cl. ..... 16/250; 16/252; 248/200; 312/109

(58) Field of Classification Search ..... 49/381, 49/169, 170; 312/109, 114, 138.1, 326; 16/250, 16/251, 252; 248/200, 229.2
See application file for complete search history.

(56) References Cited

U.S. PATENT DOCUMENTS

| | | | | |
|---|---|---|---|---|
| 5,867,869 | A * | 2/1999 | Garrett et al. | 16/252 |
| 6,070,294 | A * | 6/2000 | Perkins et al. | 16/252 |
| 6,519,811 | B1 * | 2/2003 | Cheng | 16/252 |
| 6,766,561 | B1 * | 7/2004 | Cheng | 16/235 |
| 6,966,150 | B2 * | 11/2005 | Chiang | 49/388 |
| 7,305,797 | B2 * | 12/2007 | Chiang | 49/388 |

* cited by examiner

*Primary Examiner*—A. Joseph Wujciak, III
(74) *Attorney, Agent, or Firm*—Bacon & Thomas, PLLC

(57) ABSTRACT

A frameless glass door clamp has a clamping member, a base cover and a cap cover. The clamp member has a base side surface and a cap side surface. The base cover is mounted on the base side surface and has a panel, multiple flanges, a tapered face and multiple rounded outer edges. The cap cover is mounted on the cap side surface and has a panel, a multiple flanges, a tapered face and multiple rounded outer edges. Because the outer edges of the base and cap covers are rounded, the frameless glass door clamp is much less likely to injure people or damage objects and is easier to manufacture.

12 Claims, 9 Drawing Sheets

FRAMELESS GLASS DOOR CLAMP

BACKGROUND OF THE INVENTION

1. Field of Invention

The present invention relates to a frameless glass door clamp, and more particularly to a frameless glass door clamp that is safe for people and can be manufactured easily.

2. Description of the Related Art

With reference to FIG. 9, a conventional frameless glass door clamp in accordance with the prior art is mounted on an edge or at a corner of a frameless glass door (50) so the frameless glass door (50) can be connected pivotally to a doorframe, a handle can be attached to the frameless glass door (50), or a lock can be mounted on the frameless glass door (50).

The conventional frameless glass door clamp comprises a clamping member (80), a base cover (90) and a cap cover (70).

The clamping member (80) is mounted on an edge of the frameless glass door (50) and comprises a base (81) and a cap (82).

The base (81) has an inner face, an inner longitudinal edge, an outer longitudinal edge, an inner transverse edge, an outer transverse edge, two bosses (811), two detents (812) and a clamping recess (813). The bosses (811) are formed on and protrude from the inner longitudinal edge of the base (81). The detents (812) are defined in the outer longitudinal edge of the base (81). The clamping recess (813) is formed in the inner face of the base (81) along the inner longitudinal edge and the inner transverse edge, may be formed also along the outer transverse edge corresponds to and holds a notch in a frameless glass door (50).

The cap (82) corresponds to and is fastened on the base (81) and has at least one bolt (83), an inner longitudinal edge, an outer longitudinal edge, two bosses (821) and two detents (822). The bosses (821) are formed on and protrude from the inner longitudinal edge of the cap (82). The detents (822) are defined in the outer longitudinal edge of the cap (82). The at least one bolt (83) extends through the cap (82) and screws into the base (81) to attach the cap (82) to the base (81).

The base cover (90) is mounted on the base (81) and has a panel (91), an inner longitudinal flange (92), an outer longitudinal flange (93) and multiple edges. The panel (91) of the base cover (90) corresponds to the base (81) and has an inner longitudinal side and an outer longitudinal side. The inner longitudinal flange (92) of the base cover (90) is formed on and protrudes perpendicular in from the inner longitudinal side of the panel (91) and has an inner surface and two detents (94). The detents (94) are defined in the inner surface of the inner longitudinal flange (93) and correspond respectively to and engage the bosses (811) on the inner longitudinal edge of the base (81). The outer longitudinal flange (93) of the base cover (90) is formed on and protrudes perpendicular in from the outer longitudinal side of the panel (91) and has an inner surface and two bosses (95). The bosses (95) are formed on and protrude in from the inner surface of the outer longitudinal flange (93), correspond respectively to and engage the detents (812) in the outer longitudinal edge of the base (81) to hold the base cover (90) on the base (81) when the bosses (811) on the inner longitudinal edge of the base (81) engage the detents (94) on the inner longitudinal flange (92). The edges of the base cover (90) are right-angled.

The cap cover (70) is mounted on the cap (82) and has a panel (71), an inner longitudinal flange (72), an outer longitudinal flange (73) and multiple edges. The panel (71) of the cap cover (70) corresponds to the cap (82) and has an inner longitudinal side and an outer longitudinal side. The inner longitudinal flange (72) of the cap cover (70) is formed on and protrudes perpendicular from the inner longitudinal side of the panel (71) and has an inner surface and two detents (74). The detents (74) are defined through the inner surface of the inner longitudinal flange (72) and correspond respectively to and engage the bosses (821) on the inner longitudinal edge of the cap (82). The outer longitudinal flange (73) of the cap cover (70) is formed on and protrudes perpendicular in from the outer longitudinal side of the panel (71) and has an inner surface and two bosses (75). The bosses (75) are formed on and protrude in from the inner surface of the outer longitudinal flange (73), correspond respectively to and engage the detents (822) in the outer longitudinal edge of the clamping cover (82). The edges of the cap cover (70) are right-angled.

Although the conventional clamp can be mounted on a corner or an edge of the frameless glass door (50), the conventional clamp has the following disadvantages.

1. The edges of the base cover (90) and the cap cover (70) are right-angled and may damage objects or injure people.

2. The base cover (90) and the cap cover (70) of the conventional clamp are manufactured commonly by stamping. Forming the right-angled edges of the base cover (90) and the cap cover (70) requires a large stamping force and may be impractical or require additional fabrication processes such as welding adjacent edges. In addition, dies for stamping the right-angled edges and corners may break or be damaged easily because of the large stamping force.

To overcome the shortcomings, the present invention provides a frameless glass door clamp to mitigate or obviate the aforementioned problems.

SUMMARY OF THE INVENTION

The primary objective of the present invention is to provide a frameless glass door clamp that is safe for a user and can be manufactured easily.

The frameless glass door clamp in accordance with the present invention comprises a clamping member, a base cover and a cap cover.

The clamp member has a base side surface and a cap side surface.

The base cover corresponds to and is mounted on the base side surface and has a panel, an inner longitudinal flange, an outer longitudinal flange, a tapered face, an inner cavity and multiple outer edges. The panel is flat, corresponds to, is mounted on the base side surface and has an inner surface, an inner longitudinal side, an outer longitudinal side, an inner end and an outer end. The inner longitudinal flange is formed on the inner longitudinal side of the panel of the base cover and has an inner surface. The outer longitudinal flange is formed on the outer longitudinal side of the panel of the base cover and has an inner surface. The tapered face is formed at and tapers toward the inner end of the panel of the base cover. The inner cavity is defined on the inner surface of the panel between the inner longitudinal flange and the outer longitudinal flange. The outer edges are rounded.

The cap cover corresponds to and is mounted on the cap side surface and has a panel, an inner longitudinal flange, an outer longitudinal flange, a tapered face, an inner cavity and multiple outer edges. The panel is flat, corresponds to and is mounted on the cap and has an inner longitudinal side, an outer longitudinal side, an inner end and an outer end. The inner longitudinal flange is formed on the inner longitudinal side of the panel of the cap cover and has an inner surface. The outer longitudinal flange is formed on the outer longitudinal side of the panel of the cap cover and has an inner surface. The tapered face is formed at and tapers toward the inner end of the panel of the cap cover. The inner cavity is defined on the inner surface of the panel of the cap cover between the inner longitudinal flange and the outer longitudinal flange. The outer edges are rounded.

Other objectives, advantages and novel features of the invention will become more apparent from the following detailed description when taken in conjunction with the accompanying drawings.

DETAILED DESCRIPTION OF THE INVENTION

Figure 1:
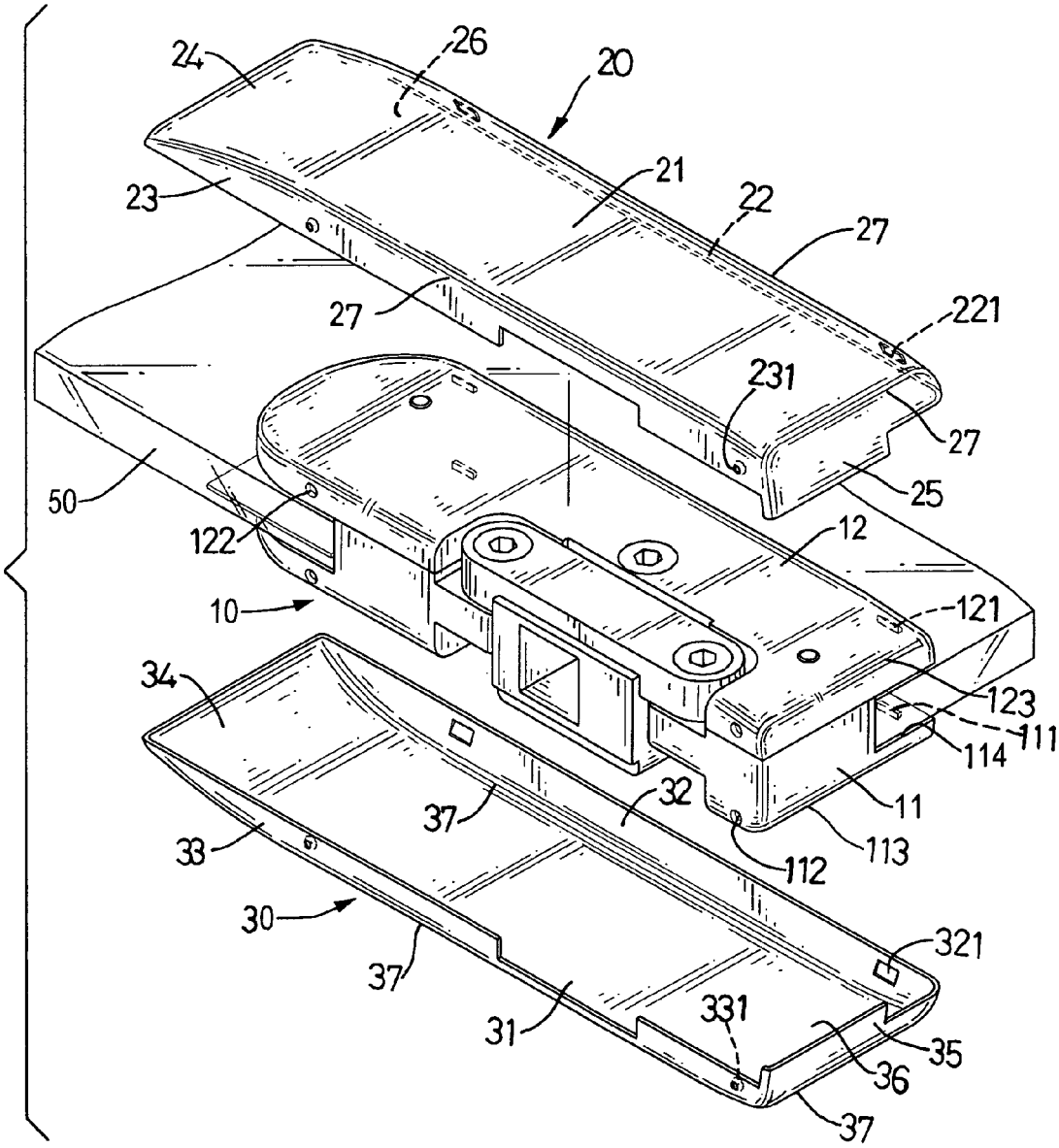
FIG. 1 is an exploded perspective view of a first embodiment of a frameless glass door clamp in accordance with the present invention.
Figure 6:
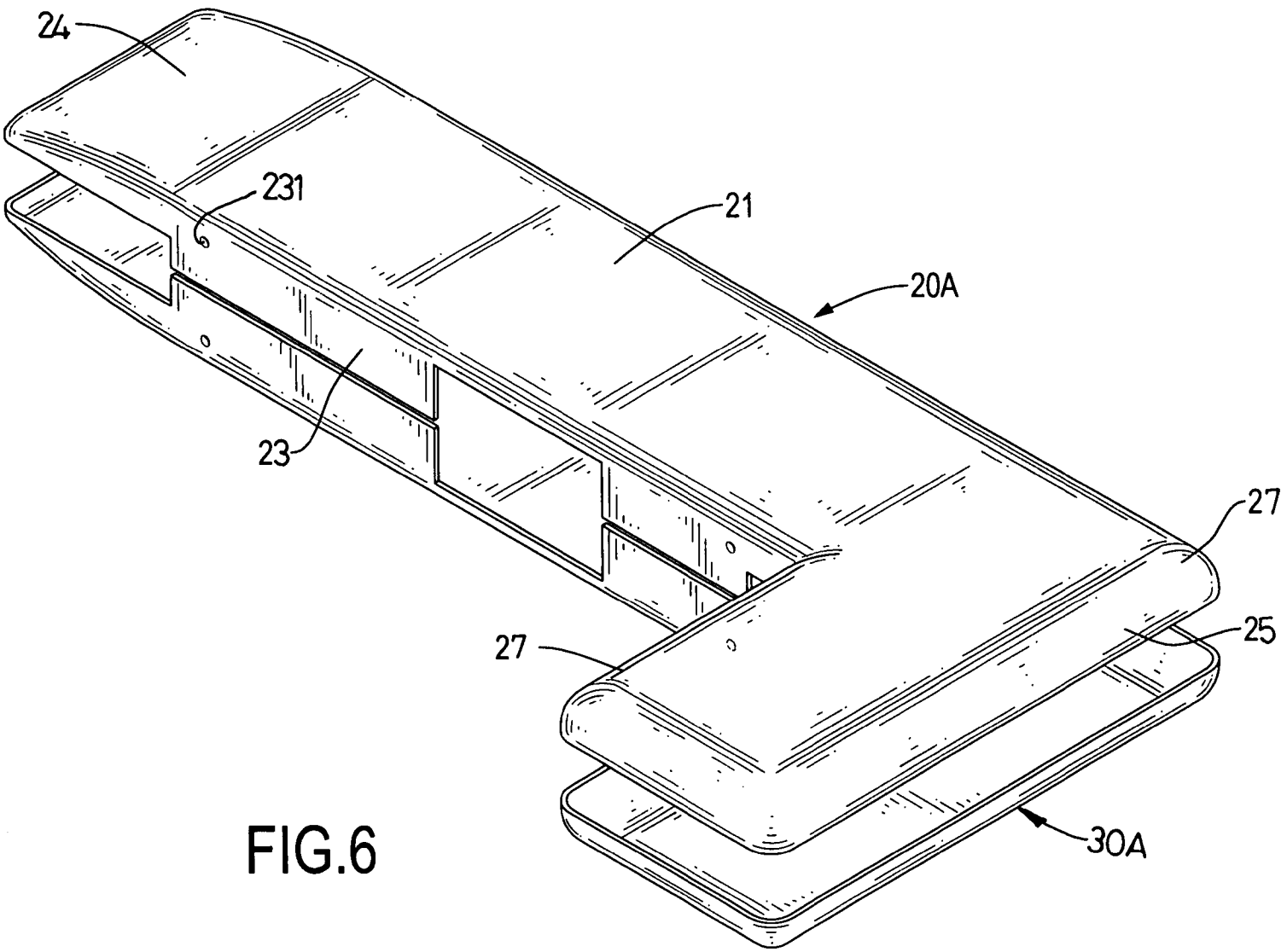
FIG. 6 is a perspective view of the base cover and the cap cover of the second embodiment of the frameless glass door clamp in FIG. 5.
Figure 7:
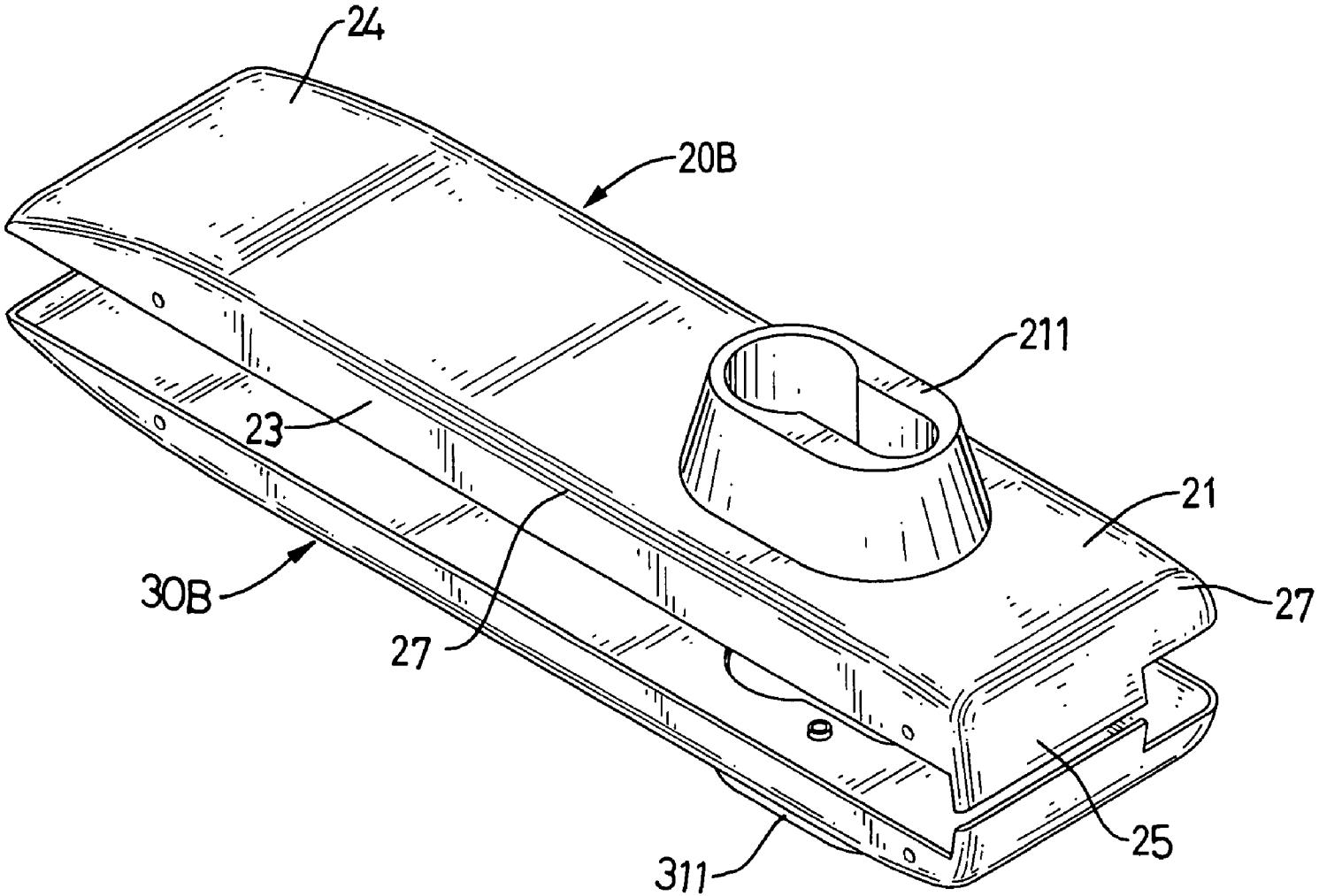
FIG. 7 is a perspective view of the base cover and the cap cover of the third embodiment of the frameless glass door clamp in FIG. 5.
Figure 8:
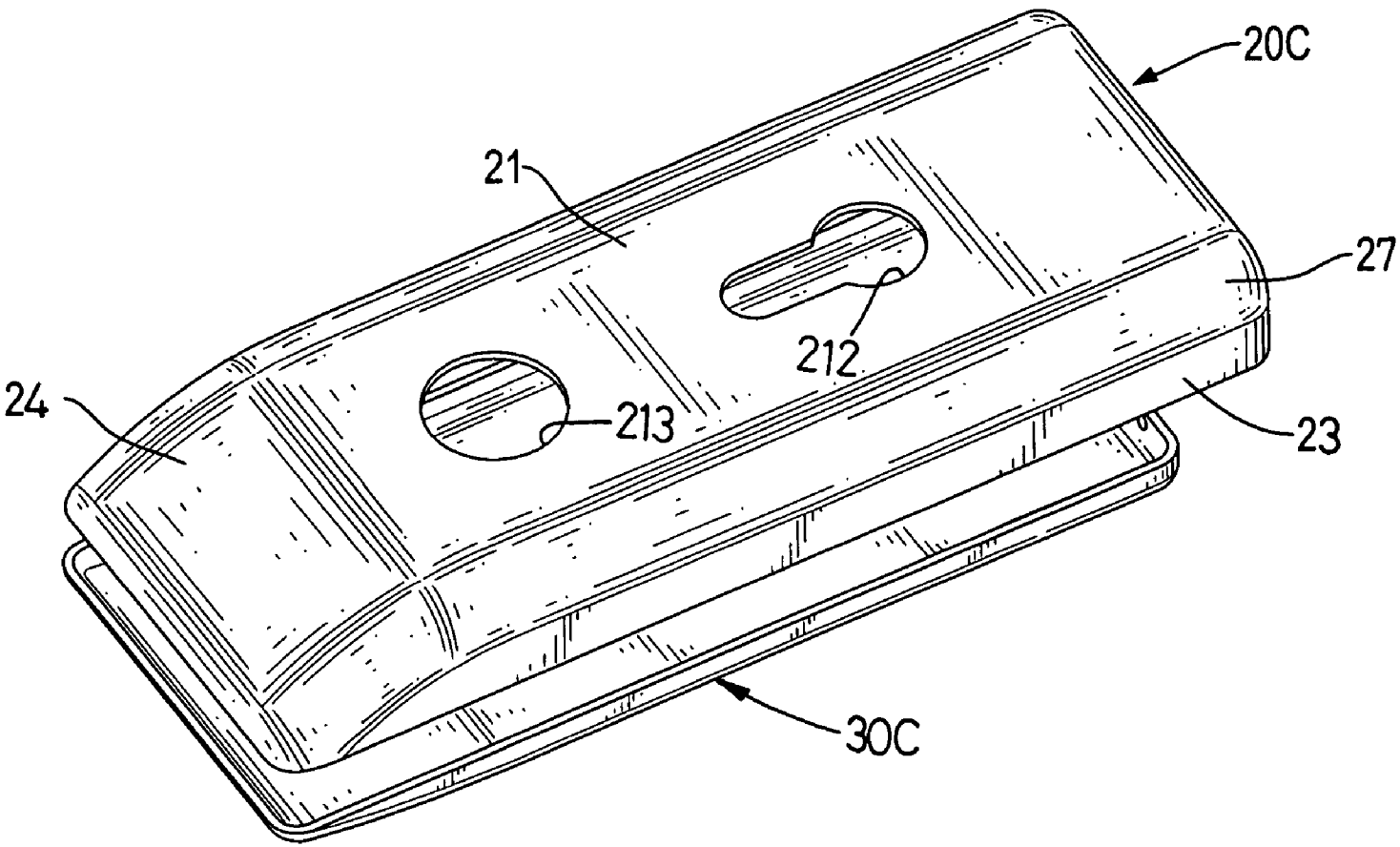
FIG. 8 is a perspective view of the base cover and the cap cover of a fourth embodiment of the frameless glass door clamp in accordance with the present invention.
Figure 9:
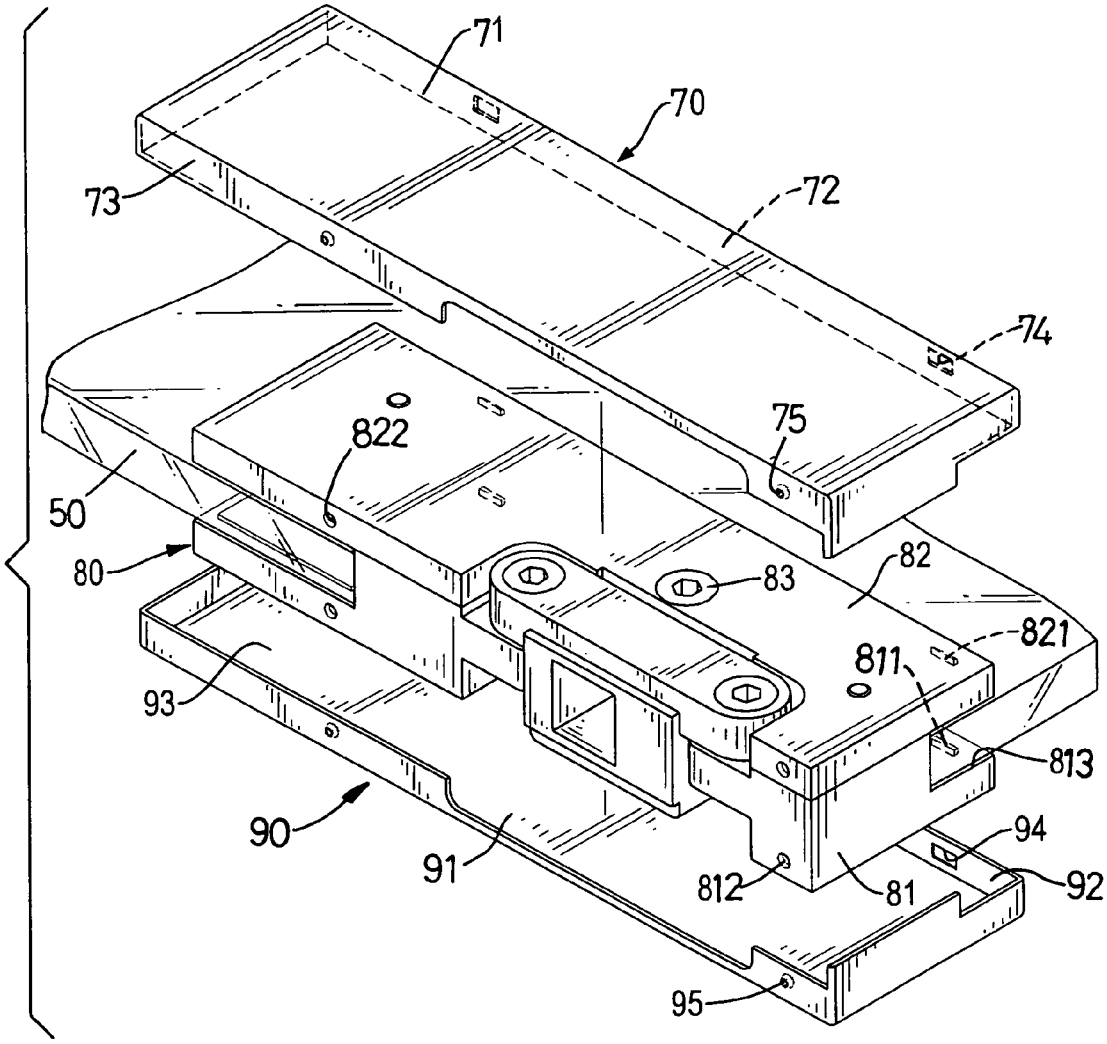
FIG.9 PRIOR ART
FIG. 9 is an exploded perspective view of a conventional frameless glass door clamp in accordance with the prior art.

With reference to FIGS. 1, 6, 7 and 8, a frameless glass door clamp in accordance with the present invention is mounted on a frameless glass door (50) or a glass doorframe (51), may be rectangular or L-shaped and comprises a clamping member (10), a base cover (30, 30A, 30B, 30C) and a cap cover (20, 20A, 20B, 20C).

Figure 2:
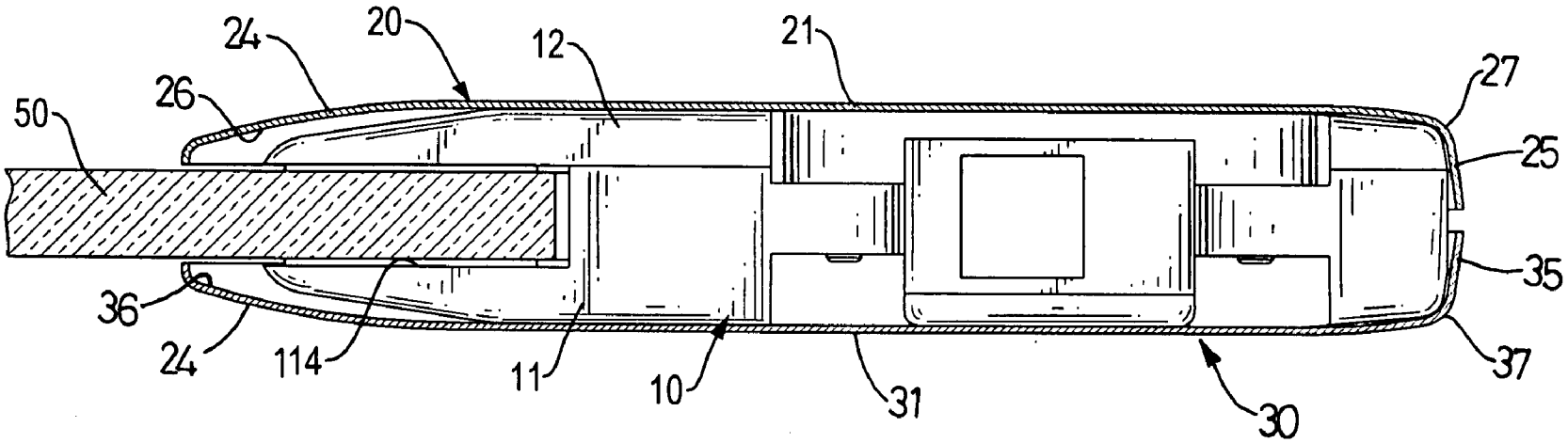
FIG. 2 is a bottom view in partial section of the frameless glass door clamp in FIG. 1.
Figure 3:
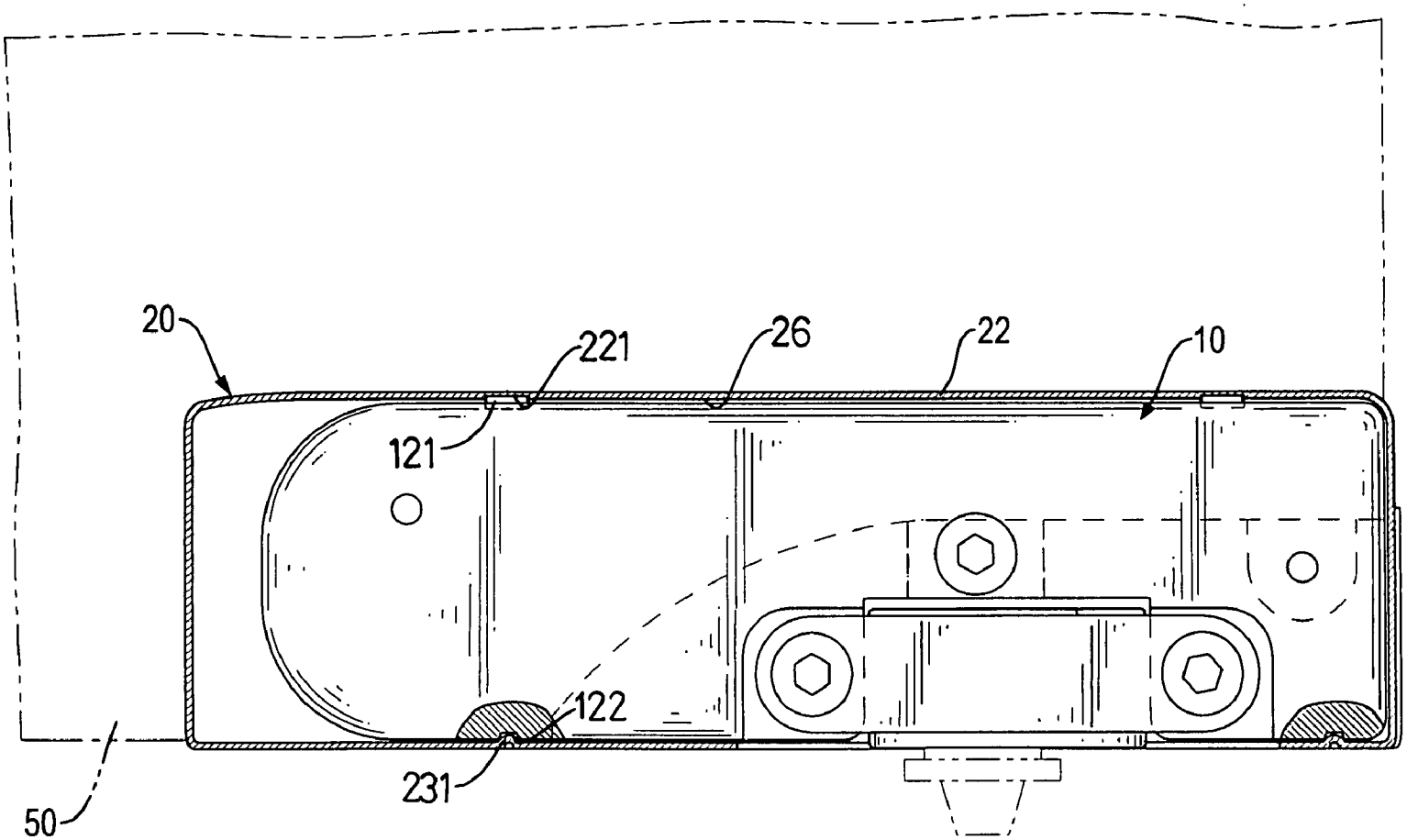
FIG. 3 is a front view in partial section of the frameless glass door clamp in FIG. 1.
Figure 4:
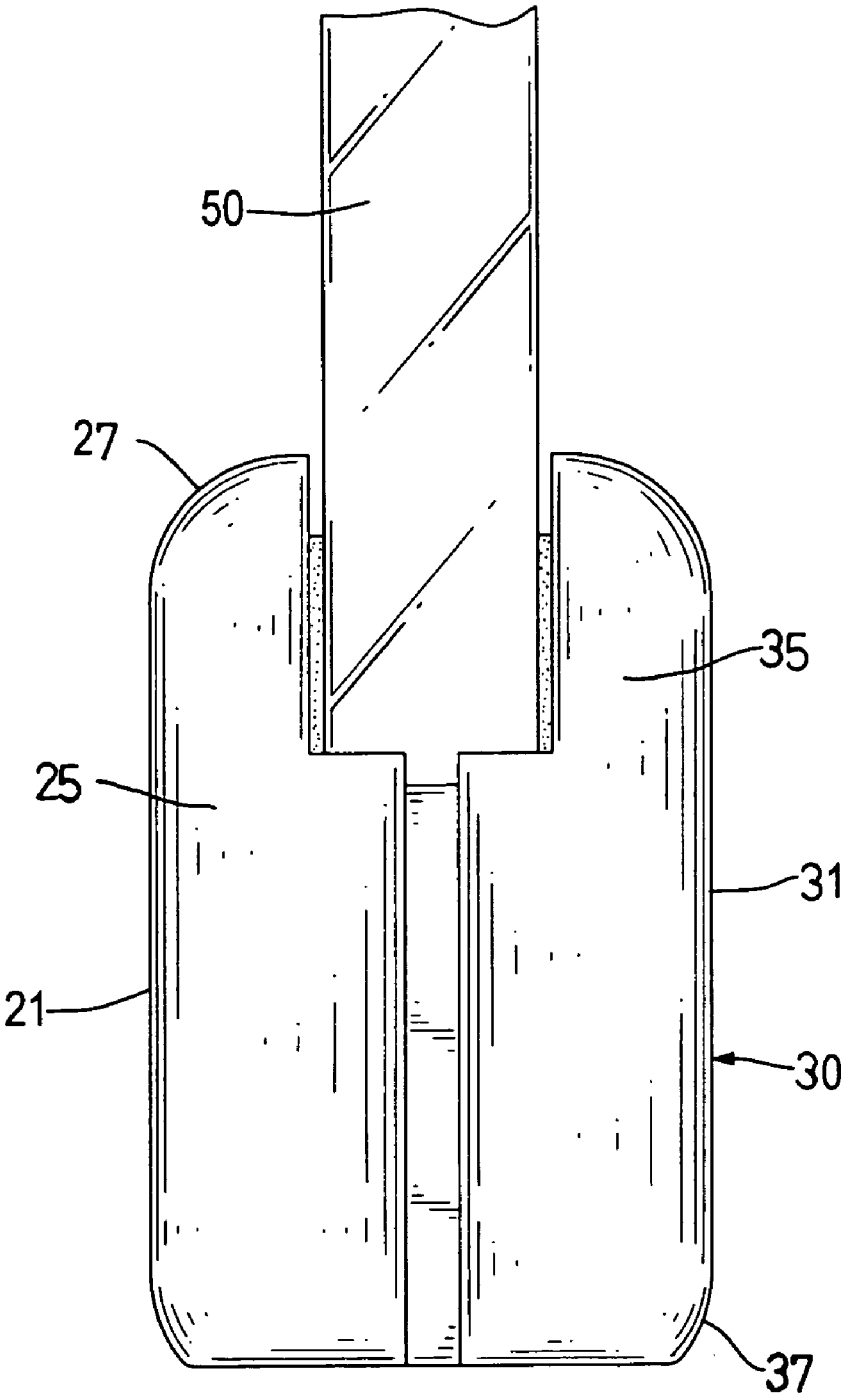
FIG. 4 is a side view of the frameless glass door clamp in FIG. 1.
Figure 5:
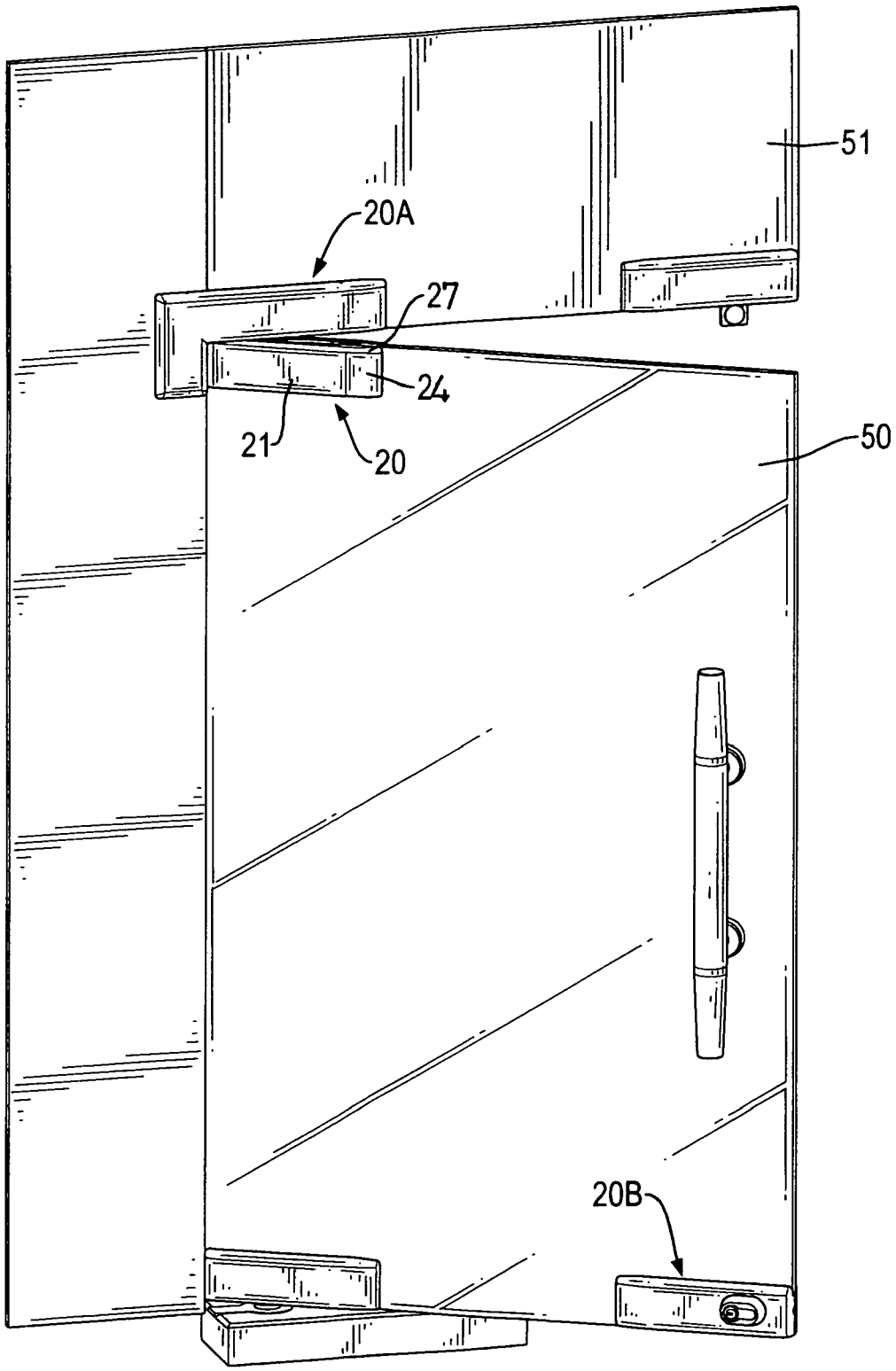
FIG. 5 is an operational perspective view of the frameless glass door clamp in FIG. 1 and a second and third embodiment of the frameless glass door clamp in accordance with the present invention.

With further reference to FIGS. 2, 3, 4 and 5, the clamping member (10) clamps onto a frameless glass door (50) or a glass doorframe (51) and comprises a base (11) and a cap (12).

The base (11) has a base side surface, an inner face and a clamping recess (114). The base side surface has an inner longitudinal edge, an outer longitudinal edge, an inner transverse edge, an outer transverse edge, at least one optional boss (111), at least one optional detent (112), and multiple outer edges (113). The at least one boss (111) is formed on and protrudes from the inner longitudinal edge of the base (11). The detent (112) is defined in the outer longitudinal edge of the base (11). The outer edges (113) may be rounded. The clamping recess (114) is formed in the inner face of the base (81) along the inner longitudinal edge and the inner transverse edge, may be formed also along the outer transverse edge and corresponds to and holds a notch in a frameless glass door (50) or a glass doorframe (51).

The cap (12) corresponds and is fastened to the inner face of the base (11), holds a frameless glass door (50) or a glass doorframe (51) in the clamping recess (114) and has a cap side surface and at least one bolt, The cap side surface has an inner longitudinal edge, an outer longitudinal edge, at least one optional boss (121), at least one optional detent (122) and multiple outer edges (123). The at least one bosses (121) is formed on and protrudes out from the inner longitudinal edge of the cap (12). The at least one detent (122) is defined in the outer longitudinal edge of the cap (12). The outer edges (123) may be rounded. The at least one bolt extends through the cap (12) and screws into the base (11) to attach the cap (12) to the base (11).

The base cover (30, 30A, 30B, 30C) corresponds to and is mounted on the base (11), may be rectangular or L-shaped and has a panel (31), an inner longitudinal flange (32), an outer longitudinal flange (33), a tapered face (34), an optional transverse flange (35), an inner cavity (36), multiple outer edges (37) and an optional lock bracket (311). The panel (31) of the base cover (30, 30A, 30B, 30C) is flat, corresponds to and is mounted on the base (10) and has an inner surface, an inner longitudinal side, an outer longitudinal side, an inner end and an outer end. The inner longitudinal flange (32) of the base cover (30, 30A, 30B, 30C) is formed on and protrudes perpendicularly in from the inner longitudinal side of the panel (31), corresponds to the inner longitudinal edge of the base (10) and has an inner surface and at least one optional detent (321). The at least one detent (321) is defined in the inner surface of the inner longitudinal flange (32) and corresponds respectively to and engages the at least one boss (111) on the inner longitudinal edge of the base (10). The outer longitudinal flange (33) of the base cover (30, 30A, 30B, 30C) is formed on and protrudes perpendicular in from the outer longitudinal side of the panel (31), corresponds to the outer longitudinal edge of the base (10) and has an inner surface and at least one optional boss (331). The at least one boss (331) is formed on and protrudes in from the inner surface of the outer longitudinal flange (33) and corresponds respectively to and engages the at least one detent (112) in the outer longitudinal edge of the base (10) to hold the base cover (30, 30A, 30B, 30C) on the base (11) when the at least one boss (111) on the inner longitudinal edge of the base (11) engages the at least one detent (321) on the inner longitudinal flange (32). The tapered face (34) is formed at and tapers toward the inner end of the panel (31). The transverse flange (35) is formed on and protrudes perpendicularly in from the outer end of the panel (31) between the inner longitudinal flange (32) and the outer longitudinal flange (33). The inner cavity (36) is defined on the inner surface of the panel (31) between the inner longitudinal flange (32) and the outer longitudinal flange (33) and holds the base (10). The outer edges (37) are rounded. The lock bracket (311) is mounted through the panel (31) of the base cover (30B).

The cap cover (20, 20A, 20B, 20C) corresponds to and is mounted on the cap (12), may be rectangular or L-shaped and has a panel (21), an inner longitudinal flange (22), an outer longitudinal flange (23), a tapered face (24), an optional transverse flange (25), an inner cavity (26), multiple outer edges (27), an optional lock bracket (211), an optional lock hole (212) and an optional buttonhole (213). The panel (21) of the cap cover (20, 20A, 20B, 20C) is flat, corresponds to and is mounted on the cap (12) and has an inner longitudinal side, an outer longitudinal side, an inner end and an outer end. The inner longitudinal flange (22) of the cap cover (20, 20A, 20B, 20C) is formed on and protrudes perpendicularly in from the inner longitudinal side of the panel (21), corresponds to the inner longitudinal edge of the cap (12) and has an inner surface and at least one optional detent (221). The at least one detent (221) is defined in the inner surface of the inner longitudinal flange (22) and corresponds respectively to and engages the at least one boss (121) on the inner longitudinal edge of the cap (12). The outer longitudinal flange (23) of the cap cover (20, 20A, 20B, 20C) is formed on and protrudes perpendicular in from the outer longitudinal side of the panel (21), corresponds to the outer longitudinal edge of the cap (12) and has an inner surface and at least one optional boss (231). The at least one boss (231) is formed on and protrudes in from the inner surface of the outer longitudinal flange (23) and corresponds respectively to and engages the at least one detent (122) in the outer longitudinal edge of the cap (12) to hold the cap cover (20, 20A, 20B, 20C) on the cap (12) when the bosses (121) on the inner longitudinal edge of the cap (11) engage the detents (221) on the inner longitudinal flange (22). The tapered face (24) is formed at and tapers toward the inner end of the panel (21). The transverse flange (25) is formed on and protrudes perpendicularly in from the outer end of the panel (21) between the inner longitudinal flange (22) and the outer longitudinal flange (23). The inner cavity (26) is defined on the inner surface of the panel (21) of the cap cover (20, 20A, 20B, 20C) between the inner longitudinal flange (22) and the outer longitudinal flange (23) and holds the cap (12). The outer edges (27) are rounded. The lock bracket (211) is mounted through the panel (21) of the cap cover (20B). The lock hole (212) is defined through the panel (21) of the cap cover (20C). The buttonhole (213) is defined through the panel (21) of the cap cover (20C). The frameless glass door clamp as described has the following advantages. The outer edges (37, 27) of the base cover (30, 30A, 30B, 30C) and the cap cover (20, 20A, 20B, 20C) are rounded, which keeps the frameless glass door clamp from injuring people or damaging objects that bump the frameless glass door clamp and improves the aesthetic appearance of the frameless glass door clamp. Furthermore, stamping the rounded outer edges (37, 27) respectively of the base cover (30, 30A, 30B, 30C) and the cap cover (20, 20A, 20B, 20C) is easy because much less force is needed. Accordingly, manufacturing the base cover (30, 30A, 30B, 30C) and the cap cover (20, 20A, 20B, 20C) is convenient and less likely to damage dies and molds used to fabricate the rounded edges (37, 27).

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A frameless glass door clamp comprising a clamping member having a base side surface configured for mounting on one side of a door and having an inner longitudinal edge;

an outer longitudinal edge;

an inner transverse edge;

an outer transverse edge;

at least one boss being formed on and protruding from the inner longitudinal edge of the base side surface; and at least one detent being defined in the outer longitudinal edge of the base side surface; and a cap side surface configured for mounting on the other side of the door and having an inner longitudinal edge;

an outer longitudinal edge;

at least one boss being formed on and protruding out from the inner longitudinal edge of the cap side surface; and at least one detent being defined in the outer longitudinal edge of the cap side surface;

a base cover corresponding to and being mounted on the base side surface and having a panel being flat, being corresponding to and being mounted on the base side surface and having an inner surface;

an inner longitudinal side;

an outer longitudinal side;

an inner end; and an outer end;

an inner longitudinal flange being formed on the inner longitudinal side of the panel of the base cover, being corresponding to the inner longitudinal edge of the base side surface of the clamping member and having an inner surface; and at least one detent being defined in the inner surface of the inner longitudinal flange and corresponding respectively to and engaging the at least one boss on the inner longitudinal edge of the base side surface;

an outer longitudinal flange being formed on the outer longitudinal side of the panel of the base cover, being corresponding to the inner longitudinal edge of the base side surface of the clamping member and having an inner surface; and at least one boss being formed on and protruding from the inner surface of the outer longitudinal flange, corresponding respectively to and engaging the at least one detent in the outer longitudinal edge of the base side surface;

a tapered face being formed at and tapering toward the inner end of the panel of the base cover;

an inner cavity being defined on the inner surface of the panel between the inner longitudinal flange and the outer longitudinal flange; and multiple outer edges being rounded; and a cap cover corresponding to and being mounted on the cap side surface and having a panel being flat, being corresponding to and being mounted on the cap side surface and having an inner longitudinal side;

an outer longitudinal side;

an inner end; and an outer end;

an inner longitudinal flange being formed on the inner longitudinal side of the panel of the cap covert being corresponding to the inner longitudinal edge of the cap side surface of the clamping member and having an inner surface; and at least one detent being defined in the inner surface of the inner longitudinal flange and corresponding respectively to and engaging the at least one boss on the inner longitudinal edge of the cap side surface;

an outer longitudinal flange being formed on the outer longitudinal side of the panel of the cap cover, being corresponding to the outer longitudinal edge of the cap side surface of the clamping member and having an inner surface; and at least one boss being formed on and protruding in from the inner surface of the outer longitudinal flange and corresponding respectively to and engaging the at least one detent in the outer longitudinal edge of the base side surface;

a tapered face being formed at and tapering toward the inner end of the panel of the cap cover;

an inner cavity being defined on the inner surface of the panel of the cap cover between the inner longitudinal flange and the outer longitudinal flange; and multiple outer edges being rounded.

2. The a frameless glass door clamp as claimed in claim 1, wherein the base side surface has multiple outer edges being corresponding respectively to the outer edges of the base cover and being rounded; and the cap side surface has multiple outer edges being corresponding respectively to the outer edges of the cap cover and being rounded.

3. The frameless glass door clamp as claimed in claim 1, wherein the clamping member further comprising a base, wherein the base side surface of the clamping member is formed on the base; and the base has an inner face; and a clamping recess being formed in the inner face of the base along the inner longitudinal edge and the inner transverse edge; and a cap being fastened to the inner face of the base and having at least one bolt extending through the cap and screwing into the base, wherein the cap side surface of the clamping member is formed on the cap.

4. The frameless glass door clamp as claimed in claim 3, wherein the base cover is L-shaped; and the cap cover is L-shaped.

5. The base for a frameless glass door as claimed in claim 3, wherein the base cover is rectangular; and the cap cover is rectangular.

6. The base for a frameless glass door as claimed in claim 3, wherein the base cover further has a lock bracket mounted through the panel of the base cover; and the cap cover further has a lock bracket mounted through the panel of the cap cover.

7. The base for a frameless glass door as claimed in claim 3, wherein the cap cover further has a lock hole being defined through the panel of the base cover; and a buttonhole being defined through the panel of the base cover.

8. The base for a frameless glass door as claimed in claim 3, wherein the base cover further has a transverse flange being formed on and protruding perpendicularly in from the outer end of the panel of the base cover between the inner longitudinal flange and the outer longitudinal flange; and the cap cover further has a transverse flange being formed on and protruding perpendicularly in from the outer end of the panel of the cap cover between the inner longitudinal flange and the outer longitudinal flange.

9. The frameless glass door clamp as claimed in claim 1, wherein the base cover is L-shaped; and the cap cover is L-shaped.

10. The frameless glass door clamp as claimed in claim 1, wherein the base cover is rectangular; and the cap cover is rectangular.

11. The frameless glass door clamp as claimed in claim 1, wherein the base cover further has a lock bracket mounted through the panel of the base cover; and the cap cover further has a lock bracket mounted through the panel of the cap cover.

12. The frameless glass door clamp as claimed in claim 1, wherein the cap cover further has a lock hole being defined through the panel of the base cover; and a buttonhole being defined through the panel of the base cover.

* * * * *